US005797724A

United States Patent [19]

Liu et al.

[11] Patent Number: 5,797,724

[45] Date of Patent: Aug. 25, 1998

[54] PUMP IMPELLER AND CENTRIFUGAL SLURRY PUMP INCORPORATING SAME

[75] Inventors: Wen Jie Liu, Lindfield; Jeff Bremer, Western Australia, both of Australia

[73] Assignee: Vortex Australia Proprietary, Ltd.

[21] Appl. No.: 464,883

[22] PCT Filed: Dec. 23, 1993

[86] PCT No.: PCT/AU93/00676

§ 371 Date: Sep. 9, 1996

§ 102(e) Date: Sep. 9, 1996

[87] PCT Pub. No.: WO94/15102

PCT Pub. Date: Jul. 7, 1994

[30] Foreign Application Priority Data

Dec. 29, 1992 [AU] Australia ..... PL6575
Dec. 29, 1992 [AU] Australia ..... PL6576

[51] Int. Cl.[6] ..... F04D 29/44

[52] U.S. Cl. ..... 415/206; 415/203; 416/223 B

[58] Field of Search ..... 415/203, 204, 415/206; 416/223 B

[56] References Cited

U.S. PATENT DOCUMENTS 4,872,809 10/1989 Addie et al. ..... 415/206

FOREIGN PATENT DOCUMENTS 1059266 12/1983 U.S.S.R. ..... 415/206

*Primary Examiner*—John T. Kwon

*Attorney, Agent, or Firm*—Allen, Dyer, Doppelt, Milbrath & Gilchrist, P.A.

[57] ABSTRACT

A pump impeller is adapted for rotatably mounting within a volute of a centrifugal slurry pump. The pump impeller has an intake opening that is formed coaxially with an axis of rotation of the impeller. The impeller also has an outlet opening that extends about the periphery of the impeller and blades that extend generally radially between the intake opening and the outlet opening. The region between adjacent blades defines a respective blade passage through which slurry flows upon rotation of the impeller. The impeller is dimensioned relative to the volute so that the ratio of the blade passage width at the entry of the blade passage to the blade width passage at the periphery of the impeller is in a range of 1.5 to 1.7, and the ratio of the diameter of the impeller to the blade passage width is in a range of 9.3 to 10.2 and that the ratio of the impeller diameter to the width of the volute is in a range of 3.8 to 4.2. This dimensioning enables the pump to operate in a specific speed range of 22 to 30.

6 Claims, 2 Drawing Sheets

PUMP IMPELLER AND CENTRIFUGAL SLURRY PUMP INCORPORATING SAME

FIELD OF THE INVENTION

The present invention relates to an impeller and volute for a centrifugal slurry pump, and to a centrifugal slurry pump incorporating said impeller and volute.

BACKGROUND OF THE INVENTION

Throughout this specification the term "centrifugal slurry pump" is intended to denote any centrifugal pump that can be used to pump slurries or other liquids containing abrasive solids in suspension.

Centrifugal pumps generally comprise an impeller mounted on a rotatable shaft and enclosed by a volute. The impeller includes an intake opening formed coaxially with the rotatable shaft and an outlet opening extending about the periphery of the impeller. A plurality of blades extend generally radially between the intake opening and the outlet opening with the region between adjacent blades defining respective blade passages through which the liquid to be pumped can flow. A liquid discharge opening is formed in the casing which usually extends along an axis generally perpendicular to the rotatable shaft. As the impeller rotates, it imparts kinetic energy to the liquid within the impeller and causes it to move in the direction of rotation and radially outward. The liquid is then carried to the discharge outlet. The area of the volute increases toward the discharge outlet, causing the kinetic energy of the liquid to be converted to pressure energy. At a given rotational speed, a centrifugal pump will operate at peak efficiency only at certain conditions of flow rate, pressure and shaft speed as determined by its design, and in particular, the combined geometry of the impeller and casing.

When designing centrifugal slurry pumps the geometry of the volute and impeller are critical in determining the efficiency and wear characteristics of the pump. The choice of design geometry is often influenced by a desire to lower flow velocity through the blade passages of the impeller and the volute. However, as the volute is widened to decrease flow velocity the pump efficiency decreases due to hydraulic losses arising from boundary layer separation, turbulence and recirculation flows. Therefore, there is a need to carefully balance the requirements of operating efficiency and wear rate in the design of slurry pumps. Hitherto, in order to obtain a satisfactory balance between the competing requirements of efficiency and wear, slurry pumps have generally been constructed to have a hydraulic efficiency of between 5% to 15% below the theoretically achievable efficiency as determined by specific speed/efficiency charts. For slurry pumps of specific speed 22 to 30 and flow rates greater than 100 liters/sec, the theoretically achievable efficiency is typically in the order of 80% to 85%.

SUMMARY OF THE INVENTION

It is an object of the present invention to provide a combination of impeller and volute for a centrifugal slurry pump of a configuration which, when in use, assists in increasing the efficiency and/or wear resistance of the centrifugal slurry pump.

According to the present invention there is provided an impeller adapted for rotatable mounting within a volute of a centrifugal slurry pump, the impeller comprising:

an intake opening formed coaxially with an axis of rotation of the impeller;

an outlet opening extending about the periphery of the impeller; and, a plurality of blades extending generally radially between the intake opening and the outlet opening, the region between adjacent blades defining respective blade passages through which a slurry is caused to flow upon rotation of said impeller, the width of each blade passage measured along a line perpendicular to a meridional flow streamline of the slurry progressively narrowing in a direction toward the periphery of the impeller, said impeller being dimensioned relative to said volute so that, the ratio of the blade passage width (b1) measured at the entry of the blade passage to the blade passage width (b2) at the periphery of the impeller is in the range of 1.5 to 1.7;

the ratio of the diameter (D2) of the impeller and the blade passage width (b2) at the periphery of the impeller is in the range of 9.3 to 10.2; and, the ratio of the impeller diameter (D2) to the width of the volute (b3) is in the range of 3.8 to 4.2, whereby, in use, said slurry pump can operate with a specific speed in the range of 22 to 30.

Preferably each blade has a camber line which follows any one of a range of curves $R(\Theta)$ where $R(\Theta)=[R_1+R_s.F(x)].\exp(\Theta.\mathrm{Tan}(\beta_1+F(x).(\beta_2-\beta_1))$ where $R_1=D_1/2$, where $D_1$ is the diameter of the intake opening $R_s=[R_2/\exp(\mathrm{Tan}\beta_2.\Theta_s)]-R_1$ $R_2=D_2/2$, where $D_2$ is the diameter of the impeller $F(x)=[\mathrm{Atan}\ (x.k)-\mathrm{Atan}\ (x_{min}.k)]/[\mathrm{Atan}(x_{max}.k)-\mathrm{Atan}(x_{min}.k)]$=Shaping function $x_{min}$=shape constant $-1<x_{min}<1$ $x_{max}=x_{min}+2$ k=Curve type constant (normally $2<k<5$)

$x=[x_{min}+(2\Theta/\Theta_s).x_{max}].k$ $\beta_1$=inlet angle and is in the range of 17° to 29°

$\beta_2$=outlet angle and is in the range of 27° to 35°

$\Theta_s$=sweep angle and is in the range of 100° to 140°

Preferably said volute has a circumferential wall substantially in the shape of a spiral having any one of a range of profiles substantially in the shape $R_{spiral}$ in which $R_{spiral}=R_2\ \exp([Q/Kb_3].\ \Theta'/2\ \pi)$ where Q=design flow rate in $m^3/s$ meridional velocity $2\pi R_2 b_2$ K=angular momentum=$V_u R_{spiral}=V_{u2}'R_2$ $V_{u2}'=V_{u2}\cdot Y_{slip}$ $Y_{slip}$=Slip factor as defined in standard pump design theory $V_{u2}=U_2-V_{m2}/\mathrm{Tan}\ \beta_2$=circumferential velocity of fluid at periphery of impeller $U_2$=Circumferential velocity of the impeller at periphery= tip speed $V_{m2}$=Meridional velocity at the radius $R_2$ $\beta_2$=Blade outlet angle in the range of 27° to 35°

$b_3$=volute width $\Theta'$=angle coordinate for generation of the angular momentum matched spiral curve $R_2$=radius of the impeller According to another aspect of the present invention there is provided a centrifugal slurry pump comprising:

a volute; and an impeller rotatably mounted with said volute;

said impeller including an intake opening formed coaxially with an axis of rotation of the impeller;

an outlet opening extending about the periphery of the impeller; and, a plurality of blades extending generally radially between the intake opening and the outlet opening, the region between adjacent blades defining respective blade passages through which a slurry is caused to flow upon rotation of said impeller, the width of each blade passage measured along a line perpendicular to a meridional flow streamline of the slurry progressively narrowing in a direction toward the periphery of the impeller, said impeller being dimensioned relative to said volute so that, the ratio of the blade width (b1) measured at the entry of the blade passage to the blade passage width (b2) at the periphery of the impeller is in the range of 1.5 to 1.7;

the ratio of the diameter (D2) of the impeller and the blade passage (b2) at the periphery of the impeller is in the range of 9.3 to 10.2; and, the ratio of the impeller diameter (D2) to the width of the volute (b3) is in the range of 3.8 to 4.2, whereby, in use, said slurry pump can operate with a specific speed in the range of 22 to 30.

Preferably each blade has a camber line which follows any one of a range of curves R(Θ) where $R(\Theta)=[R_1+R_s.F(x)].\exp(\Theta.\mathrm{Tan}(\beta_1+F(x).(\beta_2-\beta_1))$ where $R_1=D_1/2$, where $D_1$ is the diameter of the intake opening $R_s=[R_2/\exp(\mathrm{Tan}\beta_2.\Theta_s)]-R_1$ $R_2=D_2/2$, where $D_2$ is the diameter of the impeller $F(x)=[\mathrm{Atan}\ (x.k)-\mathrm{Atan}\ (x_{min}.k)]/[\mathrm{Atan}(x_{max}.k)-\mathrm{Atan}(x_{min}.k)]$=Shaping function $x_{min}$=shape constant $-1<x_{min}<1$ $x_{max}=x_{min}+2$ k=Curve type constant (normally 2<k<5)

$x=[x_{min}+(2\Theta/\Theta_x).x_{max}].k$ $\beta_1$=inlet angle and is in the range of 17° to 29°

$\beta_2$=outlet angle and is in the range of 27° to 35°

$\Theta_s$=sweep angle and is in the range of 100° to 140°

Preferably said volute has a circumferential wall substantially in the shape of a spiral having any one of a range of profiles substantially in the shape $R_{spiral}$ in which $R_{spiral}=R_2\ \exp([Q/Kb_3].\ \Theta'/2\pi)$ where Q=design flow rate in $m^3/s$ meridional velocity $2\pi R_2 b_2$ K=angular momentum=$V_u R_{spiral}=V_{u2}'R_2$ $V_{u2}'=V_{u2}\cdot Y_{slip}$ $Y_{slip}$=Slip factor as defined in standard pump design theory $V_{u2}=U_2-V_{m2}/\mathrm{Tan}\ \beta_2$=circumferential velocity of fluid at periphery of impeller $U_2$=Circumferential velocity of the impeller at periphery= tip speed $V_{m2}$=Meridional velocity at the radius $R_2$ $\beta_2$=Blade outlet angle in the range of 27° to 35°

$b_3$=volute width

Θ'=angle coordinate for generation of the angular momentum matched spiral curve $R_2$=radius of the impeller

BRIEF DESCRIPTION OF THE DRAWINGS

An embodiment of the present invention will now be described by way of example only, with reference to the accompanying drawings in which.

DETAILED DESCRIPTION OF PREFERRED EMBODIMENT

Figure 2:
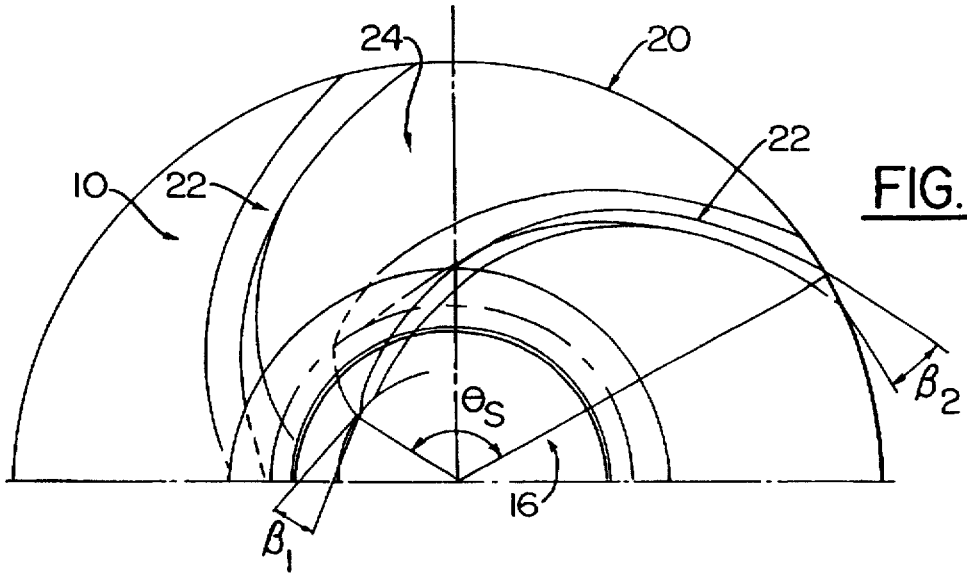
FIG. 2 is a front view of the impeller of FIG. 1.

Referring to the accompanying drawings, it can be seen that an impeller 10 adapted for rotatable mounting within a volute 12 of a centrifugal slurry pump 14 comprises an intake opening 16 formed coaxially with an axis of rotation 18 of the impeller 10, an outlet opening 20 extending about the periphery of the impeller 10, and a plurality of blades, (only two of which are shown on FIG. 2 for clarity), extending generally radially between the intake opening and the outlet opening. As most clearly seen in FIG. 2, the region, between adjacent blades 22 defines a respective blade passage 24 through which the slurry is caused to flow upon rotation of the impeller 10 out the axis of rotation 18. The impeller 10 comprises a front plate 26 in which is formed the intake opening 16 and a concentric and underlying back plate 28. A boss 30 extends from a face of the back plate 28 opposite the front plate 26 coaxially with the axis of rotation 18 and away from the front plate 26. The boss 30 is adapted to receive a shaft (not shown) which is driven by a motor for imparting torque to the impeller 10. The blades 22 extend axially between and join the front plate 26 and back plate 28.

Pump out vanes 32 extend axially from the face of front plate 26 opposite the back plate 28 and in a spiral-like manner from near the intake opening 16 to the periphery of the impeller 10. The pump out vanes 32 are used to assist in preventing recirculation of the slurry from the output opening 20 to the intake opening 16.

The impeller 10 is encased within the pump 14 by a throat bush 34 which sealingly engages a side of the volute 12 adjacent the front plate 26 and a backliner 36 which sealingly engages the opposite side of the volute 12. The throat bush 34 is formed with an inlet 38 which communicates with the intake opening 16 of the impeller 10.

The width of the impeller blade passage 24 is chosen to facilitate smooth streamline flow through the impeller 10. In order to achieve this, the blade passage 24 is progressively narrowed from its widest point at the entry of the blade passage (width b1) to the narrowest point at the impeller periphery (width b2).

Figure 1:
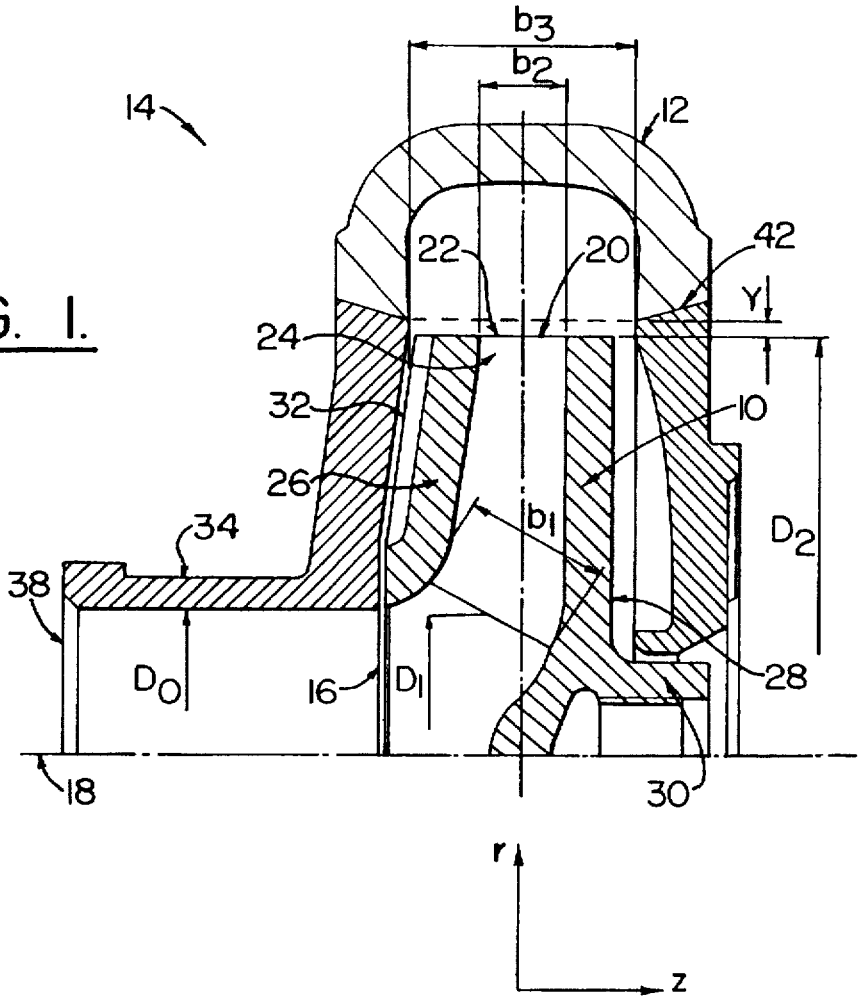
FIG. 1 is a cross-sectional view of the impeller within a centrifugal slurry pump.

The passage width at the entry b1, is commonly defined as the width along a line which is perpendicular to the meridional flow streamlines. Referring to FIG. 1, width b1 can be taken to be the straight line of closest fit to the leading edge of the blades 22 whose cylindrical coordinates (rZ) are projected onto a sectional view of the blade passage. It has been discovered that by selecting the inlet and outlet passage widths in relative portions so that the ratio of the inlet width b1 to the outlet width b2, falls in-the range of 1.5 to 1.7, the blade passages 24 have a smooth entry shape with gentle curvature at the eye of the impeller. This assists in reducing turbulence and thus reduces wear of the impeller and increases efficiency of the pump 14. While this ratio is not uncommon in high performance pumps which are used for pumping "clean liquids" without any suspended abrasive particles, slurry pumps are normally designed with blade passages in which the ratio of inlet width b1 to outlet width b2 is in the order of 1.

The ratio of impeller diameter $D_2$ to passage width $b_2$ at the periphery of the impeller 10, bears a direct relationship to the specific speed $N_s$ which is a performance index related to the head, flow and shaft speed at which the pump operates-most efficiently.

$$N_s = \frac{\text{Shaft Speed (rpm)}\zeta\ \text{Flow (m}^3\text{/s)}}{|\text{Head (m)}|^{3/4}} \quad (1)$$

As a general rule, as the specific speed decreases the resistance to wear increases and the efficiency decreases. Thus, low specific speed pumps have large narrow impellers that produce head at a relatively low shaft speed. In the impeller 10, the diameter $D_2$ to width $b_2$ geometry is arranged so that the ratio $D_2/b_2$ is in the range of 9.3 to 10.2 and the centrifugal pump 14 can operate in a specific Speed Range of 22 to 30 as defined by equation (1), above.

The shape of the blade 22 profiles are an important factor in the performance of the impeller 10 and in the development of wear in both the impeller 10 and the volute 12. The principal problem in design is to determine the inlet and outlet angles of the blade 22 across the entire width of the blade passage 24. In addition, a sweep angle must be determined which identifies how far the blade will sweep around the circle from its start at entry to the passage at diameter $D_1$ to its exit at the periphery of the impeller at diameter $D_2$.

Once the designer has determined the inlet angle $\beta_1$, outlet angle $\beta_2$ and sweep angle $\Theta_s$ of a given camber line the problem remains of how to generate a smooth curve which will satisfy those criteria? While a number of standard techniques can be found in text books, the applicant has empirically formulated an equation for defining the camber line. The formula is easily programmed and allows a wide range of suitable curves to be generated quickly by variation of the shape parameters $x_{min}$ and k defined below.

The range of values for $\beta_1$, $\beta_2$ and $\Theta_s$, and the camber line formula used to generate blade sections is as follows:

| Camber Line Parameter | Range |
|---|---|
| $\beta_1$ | 17° to 29° |
| $\beta_2$ | 27° to 35° |
| $\Theta_s$ | 100° to 140° |

The camber line is then generated in r,Θ coordinates using $R(\Theta)=[R_1+R_s.F(x)].\exp(\Theta.\mathrm{Tan}(\beta_1+F(x).(\beta_2-\beta_1))$ where $R_1=D_1/2$ $R_s=[R_2/\exp(\mathrm{Tan}\beta_2.\Theta_s)]-R_1$ $R_2=D_2/2$ $F(x)=[\mathrm{Atan}\ (x.k)-\mathrm{Atan}\ (x_{min}.k)]/[\mathrm{Atan}(x_{max}.k)-\mathrm{Atan}(x_{min}.k)]$=Shaping function $x_{min}$=shape constant $-1<x_{min}<1$ $x_{max}=x_{min}+2$ k=Curve type constant (normally 2<k<5)

$x=[x_{min}+(2\Theta/\Theta_s).x_{max}].k$

Figure 3:
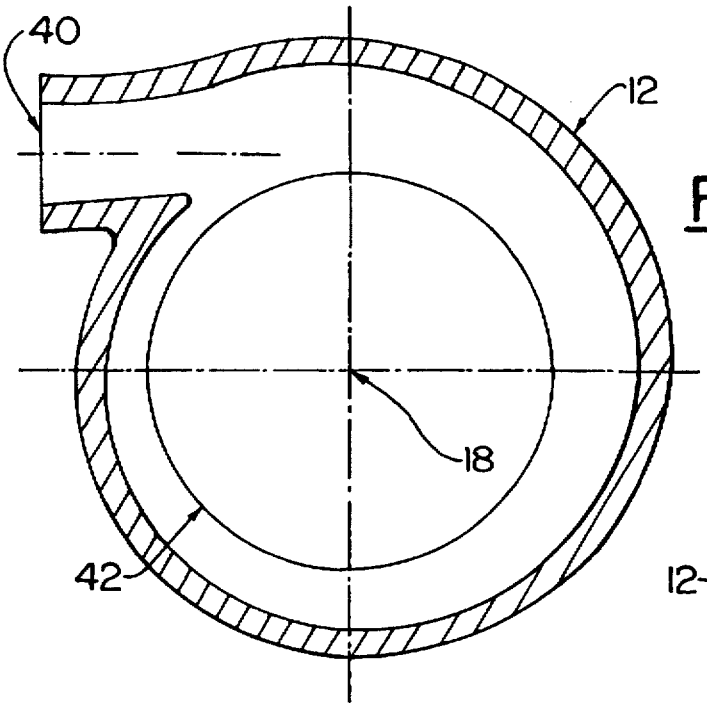
FIG. 3 is a view along Section A of the pump shown in FIG. 1.
Figure 4:
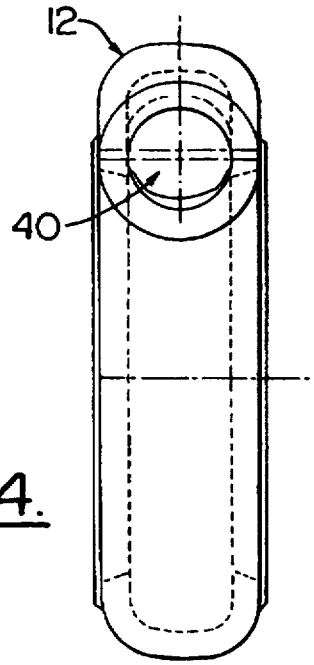
FIG. 4 is a side view of the pump.

Referring now to FIGS. 3 and 4, the volute 12 is provided with a discharge outlet 40 which extends in a direction substantially perpendicular to the axis of rotation 18. The volute 12 is formed to have a spiral profile which increases in radius in the direction of rotation of the impeller toward the discharge opening 40. However, the base circle 42 of the volute is formed of constant radius and faces the periphery of the impeller 10.

In order to increase the efficiency in the low specific speed range, the volute profile is generated from a volute width $b_3$ which is relatively narrow and not normally used for conventional slurry pumps. The applicant has discovered that high efficiencies at low specific speed with industry acceptable wear resistance can be achieved by a choice of critical geometry as shown in Table 1 below. These ratios define a narrower casing as suggested by $D_2/B_2$ in the range of 3.8 to about 4.2 than normally used in a conventional slurry pump. This is the case irrespective of whether the volute has a simple cross-sectional shape, for example, rectangular or trapezoidal or a more complex shape for example semi-circular. However, in the case of more complex cross-sectional shapes, the ratio of the widths can be calculated using well known techniques for converting a section of a complex shape to an equivalent rectangular shape of equal area. In such instances, the width $b_3$ for the "equivalent rectangle" is calculated by assuming that the clearance Y (see FIG. 1) between the impeller periphery and the base circle 42 of the volute 12 is the same for both the complex shaped and the equivalent rectangular shape.

Finally, having specified the parameters b1, b2, b3 and D2, the remaining task is generating the spiral profile of the volute 12. It is important for maximum efficiency that the volute spiral matches the performance characteristics of the impeller 10. The spiral profile $R_{spiral}$ should be generated using known principles for the conservation of angular momentum, an example of this for a volute of rectangular cross-section is as follows:

$R_{spiral}=R_2\ \exp([Q/Kb_3].\ \Theta'/2\pi)$ where

Q=design flow rate in $m^3/s^{\infty}$ meridional velocity $2\pi R_2 b_2$

K=angular momentum=$V_u R_{spiral}=V_{u2}'R_2$ $V_{u2}'=V_{u2}\cdot Y_{slip}$ $Y_{slip}$=Slip factor as defined in standard pump design theory $V_{u2}=U_2-V_{m2}/\mathrm{Tan}\ \beta_2$=circumferential velocity of fluid at periphery of impeller $U_2$=Circumferential velocity of the impeller at periphery= tip speed $V_{m2}$=Meridional velocity at the radius $R_2$ $\beta_2$=Blade outlet angle in the range of 27° to 35°

$b_3$=volute width

Θ'=angle coordinate for generation of the angular momentum matched spiral curve $R_2$=radius of the impeller A comparison of the design parameters of an embodiment of the present invention to those of another commercially available centrifugal slurry pump are provided in Table 1 below.

TABLE 1

| RATIO | Present Impeller/ Volute | Another Commercially Available Slurry Pump |
|---|---|---|
| $b_1/b_2$ | 1.5 to 1.7 | 0.9 to 1.2 |
| $D_2/b_3$ | 3.8 to 4.2 | 2.3 to 3.4 |
| $D_2/b_2$ | 9.3 to 10.2 | 5.6 to 8.6 |
| $N_s$ | 22 to 30 | 23 to 30 |
| efficiency | 81.5% | 70% |

It will be apparent from the above description that embodiments of the present invention enjoy several advantages over commercially available centrifugal slurry pumps. Notably, the efficiency of the present embodiment, with the characteristics as shown in Table 1, is in the order of 81.5% which approaches the theoretically achievable maximum, as compared with approximately 70% for the above commercially available pump. Furthermore, the geometry of the impeller reduces turbulence and decreases the impingement angle of the slurry against the volute. This has the additional benefit of reducing wear of the impeller, volute and other pump components.

We claim:

1. An impeller adapted for rotatable mounting within a volute of a centrifugal slurry pump, the impeller comprising:

an intake opening formed coaxially with an axis of rotation of the impeller;

an outlet opening extending about the periphery of the impeller; and, a plurality of blades extending generally radially between the intake opening and the outlet opening, the region between adjacent blades defining respective blade passages through which a slurry is caused to flow upon rotation of said impeller, the width of each blade passage measured along a line perpendicular to a meridional flow streamline of the slurry progressively narrowing in a direction toward the periphery of the impeller, said impeller being dimensioned relative to said volute so that, the ratio of the blade passage width (b1) measured at the entry of the blade passage to the blade passage width (b2) at the periphery of the impeller is in the range of 1.5 to 1.7;

the ratio of the diameter (D2) of the impeller and the blade passage width (b2), at the periphery of the impeller is in the range of 9.3 to 10.2; and, the ratio of the impeller diameter (D2) to the width of the volute (b3) is in the range of 3.8 to 4.2, whereby, in use, said slurry pump can operate with a specific speed in the range of 22 to 30.

2. An impeller according to claim 1 wherein each blade has a camber line which follows any one of a range of curves $R(\Theta)$ where $R(\Theta)=[R_1+R_s.F(x)].\exp(\Theta.\mathrm{Tan}(\beta_1+F(x).(\beta_2-\beta_1))$ where $R_1=D_1/2$, where $D_1$ is the diameter of the intake opening $R_s=[R_2/\exp(\mathrm{Tan}\beta_2.\Theta_s)]-R_1$ $R_2=D_2/2$, where $D_2$ is the diameter of the impeller $F(x)=[\mathrm{Atan}\ (x.k)-\mathrm{Atan}\ (x_{min}.k)]/[\mathrm{Atan}(x_{max}.k)-\mathrm{Atan}(x_{min}.k)]$=Shaping function $x_{min}$=shape constant $-1<x_{min}<1$ $x_{max}=x_{min}+2$ k=Curve type constant (normally $2<k<5$)

$x=[x_{min}+(2\Theta/\Theta_s).x_{max}].k$ $\beta_1$=inlet angle and is in the range of 17° to 29°

$\beta_2$=outlet angle and is in the range of 27° to 35°

$\Theta_s$=sweep angle and is in the range of 100° to 140°.

3. An impeller according to claim 2 wherein said volute has a circumferential wall substantially in the shape of a spiral having any one of a range of profiles substantially in the shape $R_{spiral}$ in which $R_{spiral}=R_2\ \exp(|Q/Kb_3|.\ \Theta'/2\ \pi)$ where Q=design flow rate in $m^3/s$ meridional velocity $2\pi R_2 b_2$ K=angular momentum=$V_u R_{spiral}=V_{u2}'R_2$ $V_{u2}'=V_{u2}\ .\ Y_{slip}$ $Y_{slip}$=Slip factor as defined in standard pump design theory $V_{u2}=U_2-V_{m2}/\mathrm{Tan}\ \beta_2$=circumferential velocity of fluid at periphery of impeller $U_2$=Circumferential velocity of the impeller at periphery= tip speed $V_{m2}$=Meridional velocity at the radius $R_2$ $\beta_2$=Blade outlet angle in the range of 27° to 35°

$b_3$=volute width $\Theta'$=angle coordinate for generation of the angular momentum matched spiral curve $R_2$=radius of the impeller.

4. A centrifugal slurry pump comprising:

a volute; and an impeller rotatably mounted with said volute;

said impeller including an intake opening formed coaxially with an axis of rotation of the impeller;

an outlet opening extending about the periphery of the impeller; and, a plurality of blades extending generally radially between the intake opening and the outlet opening, the region between adjacent blades defining respective blade passages through which a slurry is caused to flow upon rotation of said impeller, the width of each blade passage measured along a line perpendicular to a meridional flow streamline of the slurry progressively narrowing in a direction toward the periphery of the impeller, said impeller being dimensioned relative to said volute so that, the ratio of the blade width (b1) measured at the entry of the blade passage to the blade passage width (b2) at the periphery of the impeller is in the range of 1.5 to 1.7;

the ratio of the diameter (D2) of the impeller and the blade passage (b2) at the periphery of the impeller is in the range of 9.3 to 10.2; and, the ratio of the impeller diameter (D2) to the width of the volute (b3) is in the range of 3.8 to 4.2.

wherein, in use, said slurry pump can operate with specific speed in the range of 22 to 30.

5. A centrifugal slurry pump according to claim 4 wherein each blade has a camber line which follows any one of a range of curves $R(\Theta)$ where $R(\Theta)=[R_1+R_s.F(x)].\exp(\Theta.\mathrm{Tan}(\beta_1+F(x).(\beta_2-\beta_1))$ where $R_1=D_1/2$, where $D_1$ is the diameter of the intake opening $R_s=[R_2/\exp(\mathrm{Ta}\beta_2.\Theta_s)]-R_1$ $R_2=D_2/2$, where $D_2$ is the diameter of the impeller $F(x)=[\mathrm{Atan}\ (x.k)-\mathrm{Atan}\ (x_{min}.k)]/[\mathrm{Atan}(x_{max}.k)-\mathrm{Atan}(x_{min}.k)]$=Shaping function $x_{min}$=shape constant $-1<x_{min}<1$ $x_{max}=x_{min}+2$ k=Curve type constant (normally $2<k<5$)

$x=[x_{min}+(2\Theta/\Theta_s).x_{max}].k$ $\beta_1$=inlet angle and is in the range of 17° to 29°

$\beta_2$=outlet angle and is in the range of 27° to 35°

$\Theta_s$=sweep angle and is in the range of 100° to 140°.

6. A centrifugal slurry pump according to claim 5 wherein said volute has a circumferential wall substantially in the shape of a spiral having any one of a range of profiles substantially in the shape $R_{spiral}$ in which $R_{spiral}=R_2\ \exp(|Q/Kb_3|.\ \Theta'/2\ \pi)$ where Q=design flow rate in $m^3/s$ meridional velocity $2\pi R_2 b_2$ K=angular momentum=$V_u R_{spiral}=V_{u2}'R_2$ $V_{u2}'=V_{u2}\ .\ Y_{slip}$ $Y_{slip}$=Slip factor as defined in standard pump design theory $V_{u2}=U_2-V_{m2}/\text{Tan}\ \beta_2$=circumferential velocity of fluid at periphery of impeller $U_2$=Circumferential velocity of the impeller at periphery= tip speed $V_{m2}$=Meridional velocity at the radius $R_2$ $\beta_2$=Blade outlet angle in the range of 27° to 35°

$b_3$=volute width $\Theta'$=angle coordinate for generation of the angular momentum matched spiral curve $R_2$=radius of the impeller.

* * * * *